US005326166A

United States Patent [19]

Walthall et al.

[11] Patent Number: 5,326,166

[45] Date of Patent: Jul. 5, 1994

[54] MIXING APPARATUS

[75] Inventors: Ben J. Walthall, Santa Ana; Matthew V. Caple, Riverside; Thomas J. Murphy, Mission Viejo, all of Calif.

[73] Assignee: Irvine Scientific Sales Co., Santa Ana, Calif.

[21] Appl. No.: 965,344

[22] Filed: Oct. 23, 1992

Related U.S. Application Data

[62] Division of Ser. No. 721,826, Jun. 26, 1991.

[51] Int. Cl.[5] ..... B01F 3/12

[52] U.S. Cl. ..... 366/165; 366/183; 237/10

[58] Field of Search ..... 366/165, 173, 150, 340, 366/341, 176, 2, 183; 239/10, 400, 404, 402, 405

[56] References Cited

U.S. PATENT DOCUMENTS

| | | | |
|---|---|---|---|
| 3,304,063 | 2/1967 | Ranson | 366/165 |
| 3,697,230 | 10/1972 | Fujimoto et al. | 422/134 |
| 3,713,780 | 1/1973 | Shapiro | 23/259 |
| 4,075,089 | 2/1978 | Saari et al. | 366/264 |
| 4,218,012 | 8/1980 | Hamza et al. | 366/165 |
| 4,305,841 | 12/1981 | Gutweiler | 252/430 |
| 4,398,827 | 8/1983 | Dietrich | 366/165 |
| 4,463,097 | 7/1984 | Guigan | 436/45 |
| 4,690,899 | 9/1987 | Klose et al. | 436/45 |
| 4,729,663 | 3/1988 | Karg | 366/165 |
| 4,743,558 | 5/1988 | Guigan | 436/45 |
| 4,795,092 | 1/1989 | Fuller | 239/462 |
| 4,895,452 | 1/1990 | Yiournas et al. | 366/173 |
| 4,990,075 | 2/1991 | Wogoman | 422/58 |

*Primary Examiner*—Stephen F. Gerrity
*Assistant Examiner*—Patrick F. Brinson
*Attorney, Agent, or Firm*—Knobbe, Martens, Olson & Bear

[57] ABSTRACT

Disclosed is a unit volume mixing apparatus for reconstituting a one or more component concentrated media in an influent stream. Mixing is facilitated by a water-driven mixing vortex. The effluent fluid stream is filtered, sterilized and delivered to a sterilized receiving bag for containing a unit volume of reconstituted material.

7 Claims, 7 Drawing Sheets

MIXING APPARATUS

This application is a divisional of application Ser. No. 07/721,826, filed Jun. 26, 1991, still pending.

BACKGROUND OF THE INVENTION

The present invention relates to mixing apparatus for mixing an incoming fluid stream with a material to be mixed with the incoming fluid stream. More particularly, the present invention relates to mixing apparatus specially adapted for reconstituting powdered cell culture media in predetermined unit volume amounts.

Viable animal cells and tissue in in vitro cultures have been known since the early 1900s. While animal cell culture today is a sophisticated technology, the basic culture technique has not changed since the beginning of the century. Cells or tissue, either primary or transformed, are grown in a liquid nutrient mixture generally referred to as "media." This media is a complex mixture of amino acids, vitamins, salts, and other components. It is often supplemented with 1-10% purified bovine fetal or newborn calf serum. Cell culture media and serum are available commercially from many sources.

While the basic cell culture technique has not changed appreciably over the years, the volume of cell culture and the accessibility of this laboratory technique has increased dramatically. Not only are more research laboratories, pharmaceutical and biotechnology companies employing tissue culture techniques but they are doing so, often, on a relatively large scale. A medical product related corporation may consume tens or hundreds of liters of liquid media a day and employ large numbers of laboratory technicians and scientists to generate antibodies, growth factors or purified protein from tissue culture for commercial use. Thus, between media supply costs and employee time there is a considerable expense associated with the tissue culture process today.

Cell culture media is available commercially either as a dry powder which is reconstituted by adding an appropriate volume of water, or as a pre-packaged liquid. There are also a number of additives that are typically added to the media before use. These include sodium bicarbonate, glutamine, additional buffers or antibiotics.

Pre-packaged liquid is sterile, aliquoted into convenient sizes and is ready to use. However, the media is typically light sensitive and has a prescribed shelf-life. Therefore, media must be ordered on a regular basis. It also should by stored under refrigeration and, in its prepackaged form, requires significant man-power time to unpackage and transport. Further, shipping costs of prepackaged liquid is becoming increasingly more expensive.

Powdered media is provided in bulk or in premeasured packages. It tends to have a longer shelf life, is less expensive and requires less storage space and handling time than the liquid form. However, the powdered media must be dissolved and aliquoted under sterile conditions. The increased handling and preparation time especially for large volume media preparation often makes pre-packaged liquid media the preferred choice despite the increased cost. Thus a powdered media that is easy to prepare, requires less storage space than liquid media and whose preparation requires minimal effort will be a significant improvement over the current art.

Reconstitution of powdered media is a several step process. To prepare a liquid media from a solid powder, a known amount of powder intended for a specific volume of media is measured out and added to a volume of distilled water which is typically slightly less than the final desired volume. The powder and water are stirred until the solid is completely dissolved. Then, a specific quantity of sodium bicarbonate is added and dissolved. Sodium bicarbonate and the powdered media must not be simultaneously added to the water, or a calcium carbonate precipitate forms. The pH may thereafter be adjusted using acid or base and additional water is added to increase the media to its final volume. The entire mixture is then passed through a sterilizing filter. The media may thereafter be collected in a single large sterile vessel, or proportioned into several smaller sterile vessels.

Powdered tissue culture media has a very fine particle size and is hygroscopic. When mixed with water, it tends to "ball" or "clump." Thus, when reconstituting in water, sufficient agitation is required to break up any clumps that may form upon initial contact with water. For smaller batch sizes, sterile magnetic stir bars can be added to the mixing container and the container is then placed on a magnetic stir plate. Additional manipulations are required to add stir bars to the mixing containers. In a typical laboratory setting, magnetic stir plates are not a practical solution for large volume media preparation.

In addition, due to its hygroscopic nature, the media absorbs water when stored, especially in humid environments. Wet media has a shortened shelf-life, becomes lumpy and requires aggressive agitation to reconstitute. Thus, powdered media shelf life could be improved if it were provided in premeasured sealed and desiccated aliquots.

The reconstitution process requires several steps and several separate pieces of equipment. It generally requires at least one vessel, large enough to contain the entire final volume of reconstituted media, plus one or more vessels to receive the sterile media after filtration. The sterilized media is usually delivered into open top containers. Thus, most media preparation is done in a laminar flow hood. Processing large volumes of media in a hood is difficult because there is often not enough space to accommodate the containers and sterile media. A device that would permit the preparation of such a product with minimal physical contact and facilitate media preparation without the inconveniences described above would fulfill a long felt need in the scientific community.

There are a wide variety of solutions, the preparation of which requires the sequential dissolution or addition of components with minimum physical contact. In the research laboratory there are a range of chemicals that are purchased as a powder or series of powders or as a series of concentrates and must be prepared prior to use. Other substances may be toxic so handling should be minimized. Some chemicals are required to be free of nucleases such as those found on human hands and require sterilization before use. Still others must be free from contaminants including dusts, bacteria, viruses and fungi. As a liquid these substances may have a predetermined shelf-life and while they may be inexpensive to purchase as a powder, they are considerably more expensive to purchase and receive in a prepackaged, filtered sterile liquid form.

SUMMARY OF THE INVENTION

There is provided in accordance with one aspect of the present invention a mixing apparatus for mixing a concentrated material with an incoming fluid stream. The mixing apparatus comprises a housing having a substantially cylindrical mixing chamber therein for containing concentrated material to be mixed, and an influent port in the housing for providing fluid communication between the mixing chamber and a source of fluid. The influent port is aligned to direct incoming fluid along an axis which is generally tangential to the interior wall of the mixing chamber, thereby generating a rotational fluid velocity within the mixing chamber upon introduction of fluid under pressure. Preferably, a filter is provided in the effluent stream from the mixing chamber to substantially prevent the escape of unmixed powdered material from the mixing chamber.

A second mixing chamber is preferably provided in fluid communication with the effluent of the first mixing chamber, for containing a second concentrated material to be mixed with the incoming fluid stream. In a preferred embodiment, the first mixing chamber and second mixing chamber are in fluid communication with each other by way of a first filter. The effluent stream from the second mixing chamber is provided with a second filter for substantially preventing the escape of undissolved materials therefrom, and, optimally, a third sterilizing filter is provided in the effluent stream from the second mixing chamber in an embodiment for use with a material which is to be sterilized.

In accordance with another aspect of the present invention, there is provided a method of reconstituting a powdered material in a buffer solution. In accordance with the method, a vortex mixing apparatus having a powdered culture media in a first mixing chamber therein is provided, the apparatus also having a buffer material in a second mixing chamber.

An influent fluid stream is introduced under pressure into the first mixing chamber for contacting the powdered culture media and creating a mixing vortex therein. Thereafter, the fluid stream is directed out of the first mixing chamber and into the second mixing chamber for contacting the buffer material.

In a preferred embodiment, the effluent stream from the second mixing chamber is directed through a sterilization filter and into a receiving bag. Preferably, the volume of the receiving bag, the volume of the powdered culture media and buffer are all coordinated so that the introduction into the first chamber of a sufficient volume of fluid to substantially fill the bag provides a unit volume of reconstituted culture media.

In accordance with a further aspect of the present invention, a parallel flow mixing apparatus is provided in which an incoming fluid stream is divided into two or more fluid streams, each of which in turn drives a separate mixing chamber. Variations of water-driven mixing include the water-driven vortex alone, or water-driven vortex together with an internal mixing blade. Alternatively, external water-driven mixing means may be used including an external water-driven turbine rotationally coupled with an internal mixing blade. Additional external mechanical mixing means, such as magnetic stir bar or rotationally coupled motor-driven external mixing means, are also provided.

These and additional features and variations on the invention will become apparent to one of ordinary skill in the art from the detailed description of preferred embodiments which follows, when considered together with the attached drawings and claims.

DETAILED DESCRIPTION OF THE INVENTION

Figure 1:
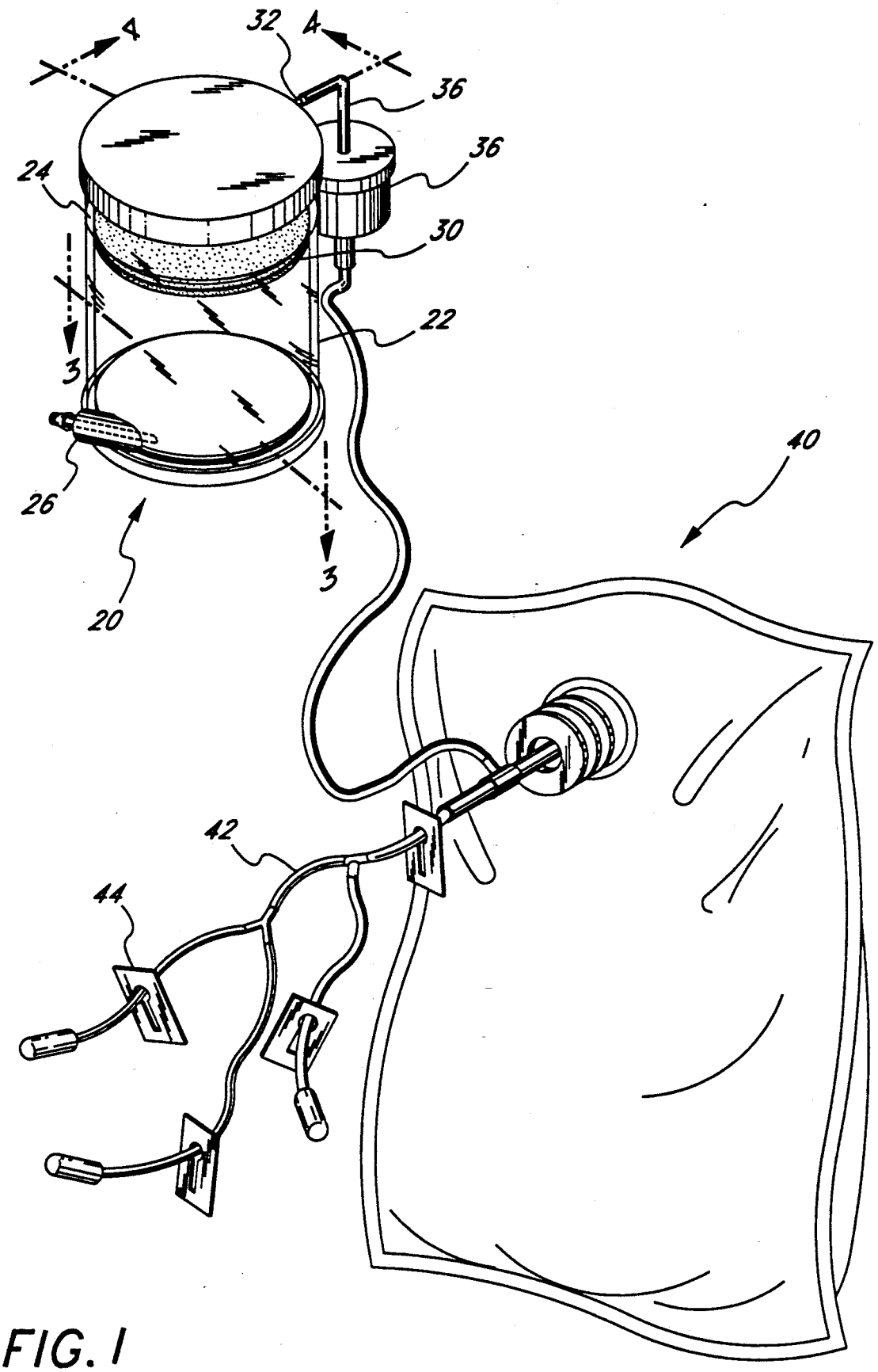
FIG. 1 is a schematic representation of the overall mixing chamber, sterilization filter, and receiving receptacle system in accordance with one embodiment of the present invention.

FIG. 1 is an overall system view of one embodiment of the mixing apparatus 20, filter 36 and receiving bag 40 in accordance with the present invention. The mixing apparatus 20 comprises at least one, and preferably two chambers. The generally cylindrical first chamber 22 constitutes the lower chamber in the preferred embodiment depicted herein and a second chamber 24 constitutes the upper chamber of this preferred embodiment. For descriptive purposes "chemical A" will refer herein to the material contained in first chamber 22 and "chemical B" will refer to the material contained in the second chamber 24 in a two chamber embodiment.

An incoming fluid stream enters the mixing chamber 20 through an influent port 26. The axis of the influent port enters first chamber 22 at substantially a tangential angle to the interior wall thereof such that liquid entering the first chamber through influent port 26 follows the sides of the chamber to create a circular mixing motion that facilitates mixing of chemical A with the fluid stream within the first chamber. As chemical A dissolves in the liquid and additional liquid enters into first chamber 22, the liquid level advances upward through divider 30 and enters the second chamber 24. Fluid containing chemical A passing through chamber divider 30 (FIG. 1) and entering into the upper chamber now comes in contact with chemical B.

Figure 2:
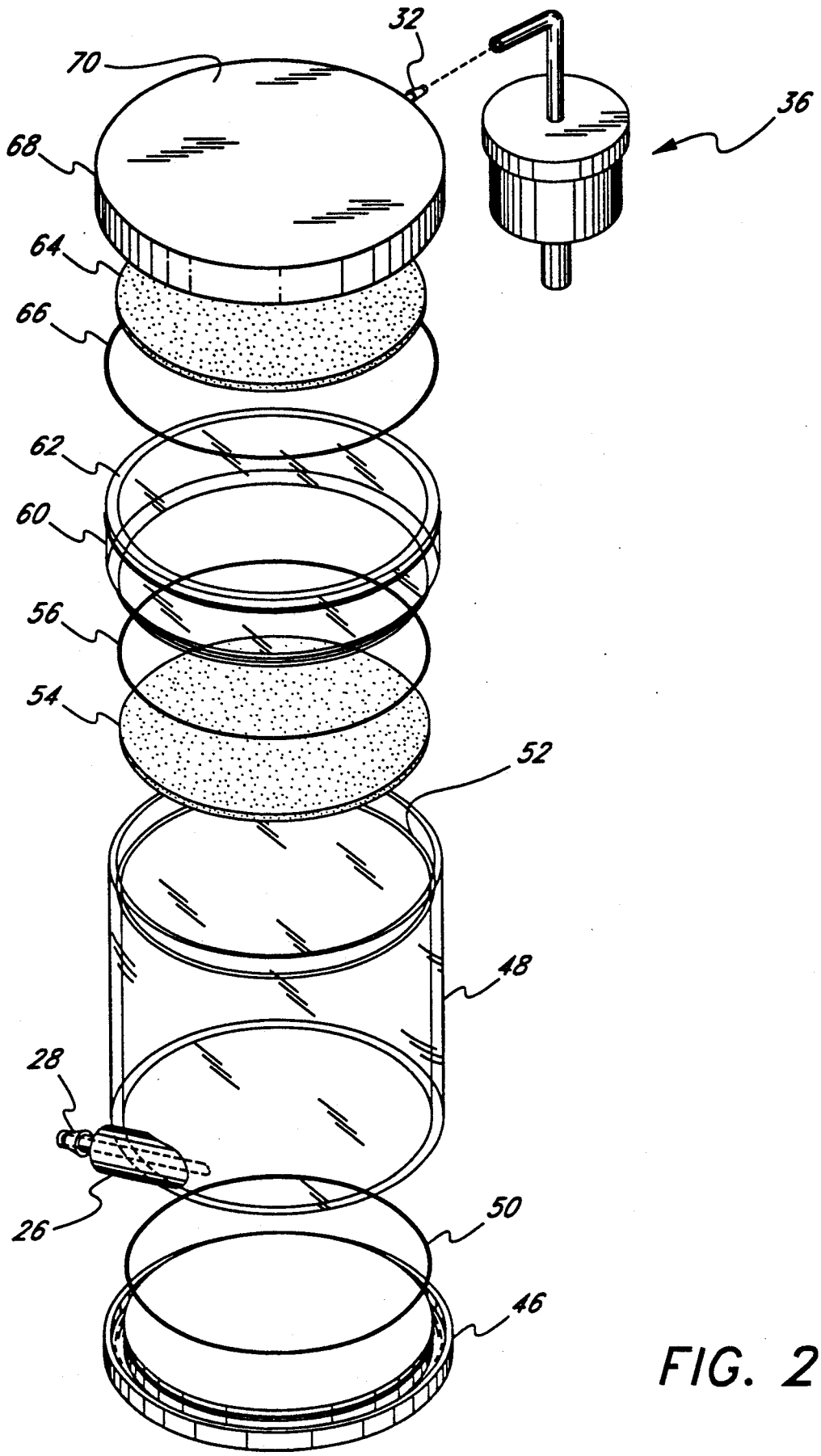
FIG. 2 is an exploded elevational view of the embodiment of the mixing chamber and external sterilization filter illustrated in FIG. 1.

In a preferred embodiment, chemical B has increased solubility characteristics over chemical A such that agitation is not necessary to facilitate the dissolution of chemical B in liquid which already contains chemical A. Liquid containing dissolved chemicals A and B thereafter exits second chamber 24 through an effluent port 32 preferably after passing through a filter 64 (FIG. 2). Liquid passing through effluent port 32 then enters outlet tubing 34 and in a preferred embodiment enters into sterilization filter 36. Sterile liquid containing chemical A and chemical B thereafter exits filter 36 and passes into a receiving receptacle 40.

It is further contemplated that the final product may require the addition of one or more other liquid additives, or the receptacle 40 may be drained into a series of different containers. Therefore, multiple inlet ports generally designated as multiple inlet ports 42 are typically provided. Flow stop regulators 44 are preferably associated with each of the inlet ports to provide control for the sequential draining or influx of the desired additive solutions.

FIG. 2 depicts in detail an exploded view of a preferred mixing apparatus embodiment. Mixing apparatus base 46 is combined with lower chamber housing 48 in association with a seal 50. Lower chamber housing 48 and base 46 are preferably substantially cylindrical in shape to optimize the rotational velocity of the fluid which has been driven through influent port 26 under pressure. The seal 50 is preferably an elastomeric O-ring but could be a gasket or other sealing device known to those with skill in the art.

Lower chamber housing 48 is provided with an influent port 26, generally tangentially oriented to the interior wall of the housing. Influent port 26 may be integrally molded with the housing 48, or can be affixed thereto in any of a variety of ways known in the art such as by adhesive, solvent or heat bonding techniques. Preferably, influent port 26 is located in the lower half of the housing 48, and more preferably along the lower one-fourth of the housing 48. A hose barb or other conventional connector is preferably affixed to influent port 26.

The upper inner surface of the housing 48 preferably contains an annular shoulder or support structure 52. The support structure 52 is preferably integrally molded together with or milled into the chamber housing 48 to form a ledge or lip to support a chamber divider which in this preferred embodiment is microporous circular filter disc 54. The support device 52 could alternatively comprise a plurality of support pegs or grooves made of the same material as the cylinder casing.

The filter disc 54, while preferably made of microporous Porex TM plastic (Porex Technologies, Fairburn, Ga.), could additionally be made of glass, wool, micron meshing, or any of a variety of other inert substances having suitable compatibility with the solvents and powders to be used in the apparatus. Preferably, the filter material will have a sufficiently small pore size to prevent escape of the powdered media. For the preferred application described herein, the filter preferably has a pore width of approximately 90–130 microns. The filter disk permits liquid passage into the second chamber but generally prevents the movement of undissolved solids from the first chamber 22 to the second chamber 24. Further undissolved solids trapped in the microporous filter are subsequently dissolved by the continued flow of fluid passing through the filter.

The two chambers are preferably adjacent one another and separated from one another by a microporous plastic filter disc 54. However, it is also contemplated that the first chamber 22 and second chamber 24 be remote from one another, so long as they can be placed in fluid communication with each other during the service cycle. FIG. 2 illustrates a preferred embodiment where first and second chambers 22, 24 are axially aligned in a water tight seal such that liquid enters the first, or lower chamber, and moves to the second or upper chamber passing through circular filter disc 54. In this construction, a second seal 56 such as an elastomeric O-ring is used to provide a tight seal between the upper and lower chambers. During manufacture, chemical A is preferably placed into first chamber 22 before the circular microporous filter disc 54 has been put into place. Construction materials are discussed infra. In a preferred embodiment, lower chamber 22 is made of the same material as upper chamber 24.

The upper chamber housing 60 is also preferably provided with a filter support 62. A second circular filter disc, the effluent filter 64, is placed on top of the filter support 62 following addition of chemical B. A third seal 66 is preferably used to provide a water tight seal between the mixing chamber cap 68 and the upper chamber housing. Effluent filter 64 preferably sits at least about one-eighth of an inch from the interior surface of cap 70. This provides space for liquid containing chemicals A and B to pass through the effluent filter and leave via effluent port 32.

When a sterile product is required, the fluid preferably passes through the effluent port 32 and into a sterilization unit 36. Sterilization units of the type contemplated by this invention can be purchased from a number of suppliers. One commercial supplier is Pall Corporation, Courtland, Me. For a sterile media product, the sterilization filter apparatus will typically contain a 0.2$\mu$ filter. The filter may comprise nylon or cellulose acetate.

It is additionally contemplated that other types of filter sizes could be chosen for other functions. For example, the preparation of electrophoretic buffers requires clean, but not necessarily sterile solutions and a 0.45$\mu$ filter would be adequate. Similarly, the preparation of more viscous solutions may necessitate a wider pore size. For other applications of the invention disclosed herein, no filtration apparatus need be added. Liquid then passes directly to a receiving receptacle through flexible tubing. If a sterile filter is used, then tubing and all additional chemicals entering multiple inlet ports 42 as well receiving receptacle 40 should be sterile (see FIG. 1).

In use, liquid enters the mixing chamber through influent port 26. A hose is preferably affixed to the influent port and locks in place via the hose barb connector. In a preferred embodiment, standard flexible laboratory tubing of diameter sufficiently large such that the tubing will pass over the neck of the hose barb and sufficiently small that the tubing seals over the hose barb nozzle is employed to direct the incoming fluid stream to the mixing chamber. The other end of the flexible tubing is preferably applied directly to a source of fluid. In the preferred culture media application of the present invention, the influent port 26 is placed in fluid communication with a distilled ionized water ($ddH_2O$) source having an adapted nozzle such as is found in most scientific laboratory $ddH_2O$ faucets. Other tubing materials, nozzle adapters, and pumps may be required for use with other water sources or liquid solvents.

Faucet pressure or other inflow pressures in excess of about 1 psi are generally sufficiently strong to permit proper apparatus function. Typical tap pressure, in the area of about 25 psi is sufficient for many embodiments of the invention. The minimum effective pressure is a function of the scale of the first mixing chamber, the volume of chemical A contained therein and the diameter of the influent lumen, as will be understood by one of skill in the art. Some routine experimentation may be required to optimize these parameters for specific applications. In one exemplary embodiment, utilized with an influent line pressure of about 1 to 10 psi, the first chamber is a cylindrical chamber having an interior diameter of about 4.541 , an internal height of about 4", and an influent port diameter of about 3/16".

Figure 3:
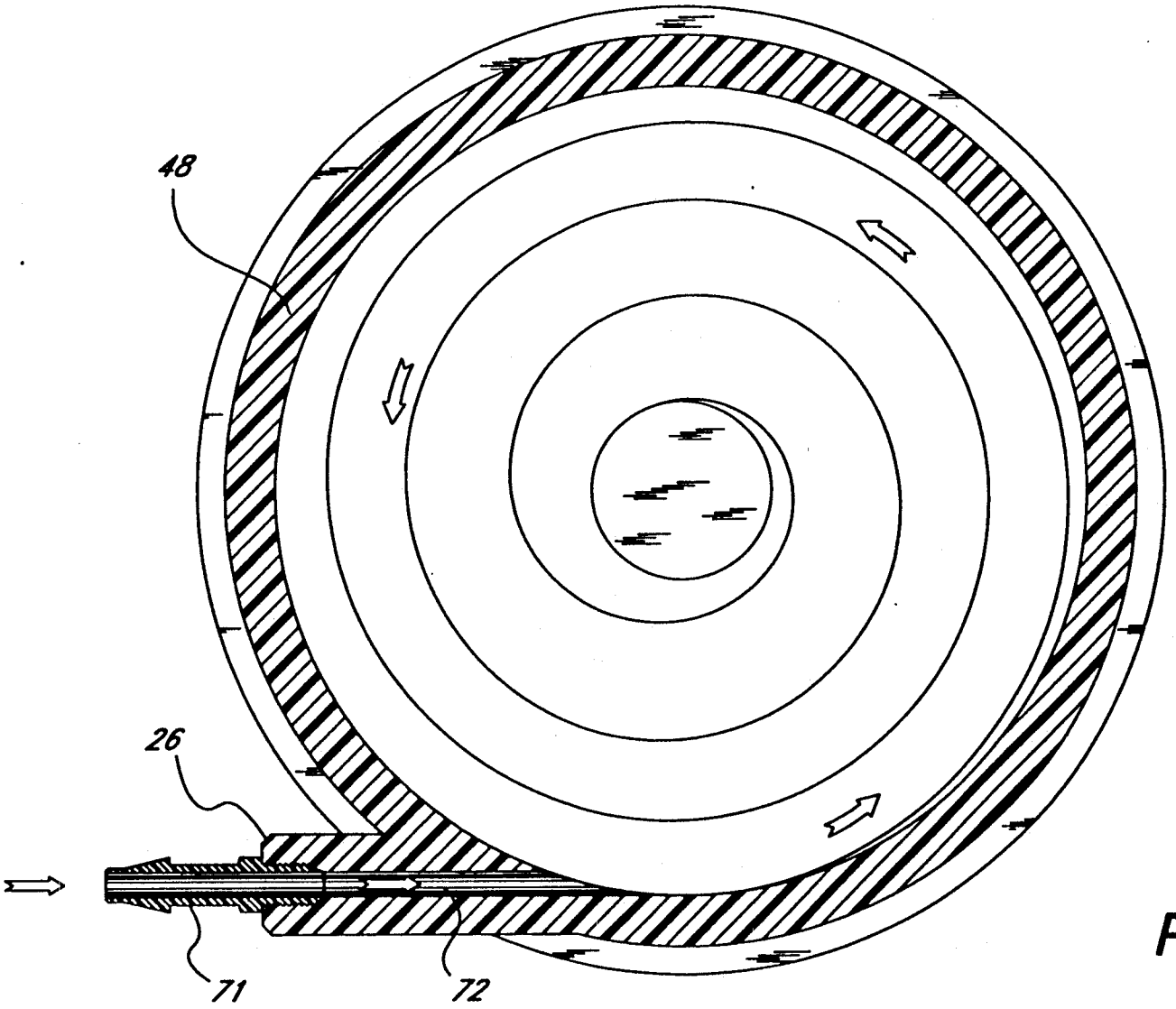
FIG. 3 is a top cross-sectional view along the lines 3—3 in FIG. 1, showing the tangential orientation of the influent flow path.

FIG. 3 is a horizontal cross sectional view across plane 3—3 of FIG. 1 showing a hose barb 71 connected to influent port 26. As previously described, liquid enters the lower chamber under pressure at substantially a tangent to the interior wall of the chamber. The velocity of the liquid entering the apparatus is determined by the incoming fluid stream pressure and can be additionally manipulated by altering either the diameter of the influent port or the dimensions of the first chamber. Decreased influent port diameters will increase the velocity of liquid entering the chamber, while increased influent port diameters will decrease liquid velocity. Preferably the pressure of the liquid stream in combination with a compatible influent port diameter will provide sufficient liquid velocity such that liquid entering the apparatus follows the surface of the inner chamber casing and continues along the pathway designated by the arrows of FIG. 3. If the rotational fluid velocity of the liquid is sufficient, the motion subsequently establishes a turbulent vortex that serves to mix the influent liquid with the contents of the first chamber.

Figure 4:
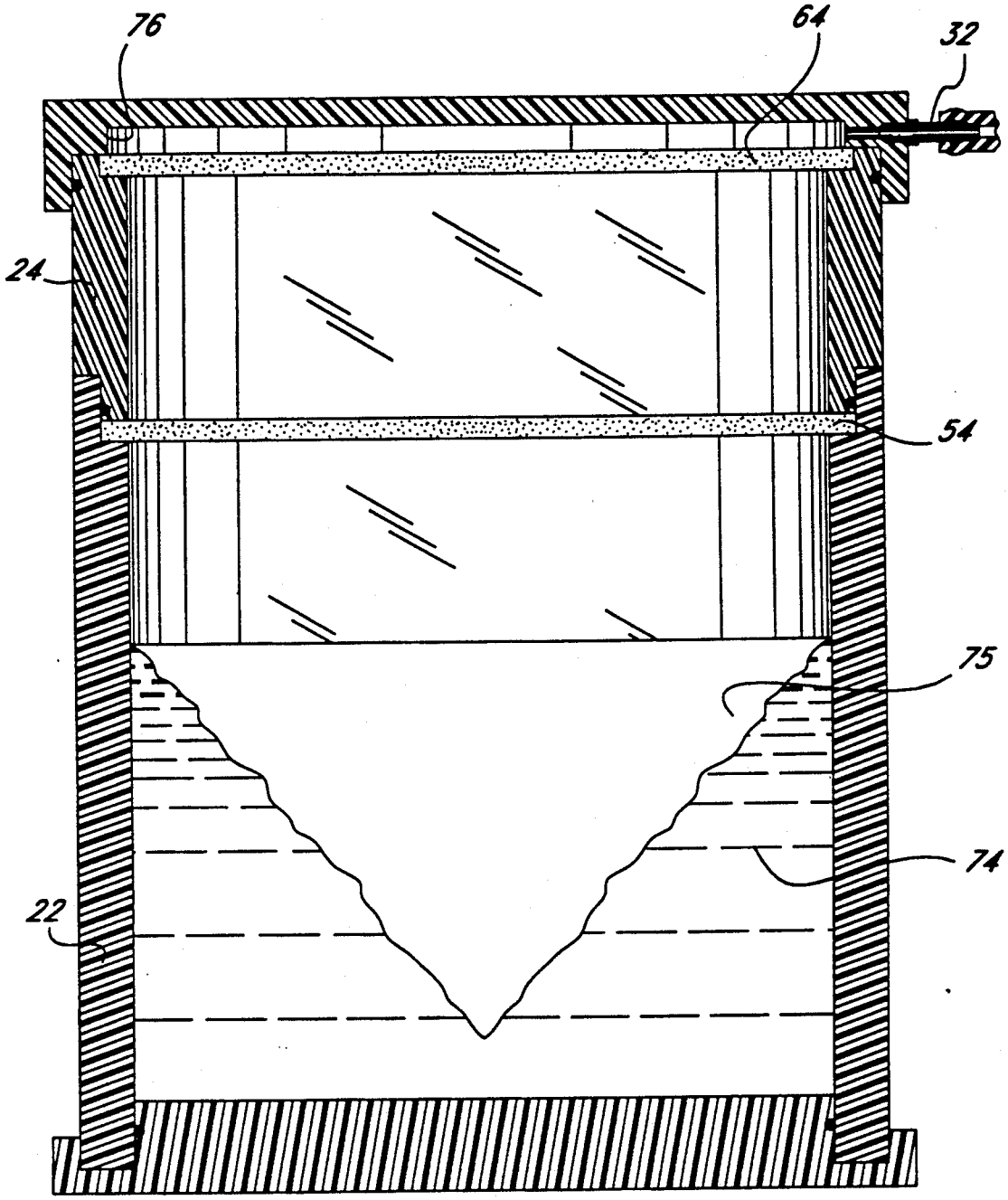
FIG. 4 is an elevational cross-sectional view of the mixing chamber shown in FIG. 1 with a representation of a fluid vortex in the lower mixing chamber.

FIG. 4 depicts an elevational cross-sectional view of the mixing apparatus of FIG. 1. The dashed horizontal lines 74 represent the swirling fluid that creates a roughly conical region of air 75 at its center. The swirling vortex mixes the contents of the first chamber 22. Additional fluid entering the chamber pushes the vortex up the sides of the first chamber and through the microporous filter disc 54 into the second chamber 24.

Once the fluid has reached second chamber 24, the flow becomes laminar. Chemical B, located within the upper chamber, preferably has increased solubility characteristics over chemical A and therefore readily dissolves in the liquid containing chemical A. The upper chamber fills and fluid containing chemical A and B passes from the upper chamber through the effluent filter and into the cap reservoir space 76. In this embodiment the effluent filter is made from the same material as circular filter disk 54. Effluent port 32 provides an outlet for the mixed product. It is alternatively contemplated that an effluent filter 64 may be deleted in which case the sterilization filter 36 could also function to trap undissolved solids.

To create sufficient influent velocity, the liquid should enter the mixing chamber under adequate pressure to mix or dissolve chemical A. It is contemplated that slight modifications of the apparatus described in the examples provided below will be required for the proper functioning of the mixing chamber for other applications. For example, if the liquid is water and the product is tissue culture media, then normal faucet pressure, in concert with an appropriate influent port dimension will create sufficient liquid pressure to generate the desired rotational fluid velocity. The mixing chamber influent port diameter has a direct effect on inlet velocity. As noted above, the inlet diameter can be increased or decreased to adjust the velocity in order to provide an adequate vortex.

The interior of the first chamber preferably has a substantially cylindrical configuration. This establishes a vortex guide for the liquid flow. Moreover, the cylinder diameter should complement the incoming fluid velocity. A first chamber diameter that is too large for a given influent flow will not support sufficient centrifugal force along its sides to maintain a vortex. Interior diameters that are too small could create excessive turbulence initially, but not form a vortex, thereby potentially resulting in inadequate mixing. The substantially cylindrical shape in combination with the inlet velocity and the inlet angle thus combine to set up the desired vortex.

Alternatively, other chamber configurations which exhibit radial symmetry may also be used for the first chamber 22. For example, spherical, hemispherical, toroidal or the like may be selected. In addition, linear-walled non-cylindrical shapes such as a frusto-conical chamber may also be used.

In the preferred embodiment detailed in FIG. 2, the diameter of the first chamber has been found to optimally be proportional to its height. A height to diameter ratio greater than about 2.5:1 will typically not support the generation of a sufficiently strong vortex at influent flow rates of about 1–3 liters per minute.

Figure 5:
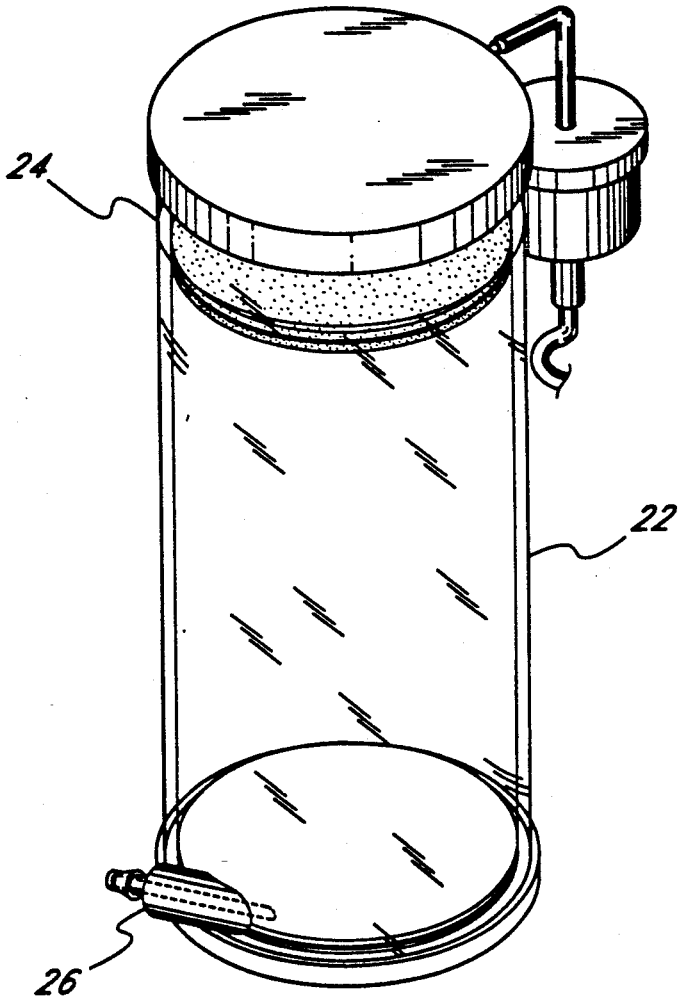
FIG. 5 is an elevational perspective view of a second embodiment of a mixing chamber in accordance with the present invention.

FIG. 5 is an elevational perspective of a second embodiment of the apparatus of the present invention. Here first chamber 22 has a height significantly greater than the height of the second chamber. Under proper incoming fluid stream velocities, this apparatus could house a larger quantity of chemical A, than the embodiment disclosed with regard to FIG. 2.

In a preferred application of the invention, the mixing apparatus is used to prepare tissue culture media. It is contemplated that the mixing chamber will be provided prefilled with powdered media in a variety of unit volume sizes. For example, mixing chamber sizes to accommodate the preparation of 1 liter (l), 10 l, 20 l, 50 l, and as large as 100 l or larger final tissue culture media volume are contemplated. Increasing amounts of powder in the lower chamber will require increased cylinder height and/or diameter to generate a vortex of sufficient size so as to maintain the powder in motion within the vortex until it dissolves. In addition, larger sizes may require a pump on the influent line to generate sufficient influent flow to sustain a vortex. Therefore it is contemplated that each apparatus be specifically designed to complement the final volume of product to be prepared.

Testing has determined that a powder volume greater than about 50% of the chamber volume for the powdered culture media application results in poor vortex mixing and inefficient liquid reconstitution. Testing has additionally determined that during operation of the mixing apparatus herein disclosed, improved reconstitution of the powder in the liquid is achieved by interrupting the inflow occasionally for approximately five seconds. Interrupting the flow temporarily releases pressure within the chamber thus allowing clumps of powder to draw fluid to their interior.

A precalibrated receptacle 40 can be used to determine the end point of media preparation. Alternatively, a predetermined volume of liquid can be pumped through the system or a flow meter/accumulator can be used to monitor the volume of the finished product. It is additionally contemplated that the final volume of the liquid product can be determined by weight. The receiving receptacle is placed on a scale and the receptacle is filled until the final weight of the end product is achieved.

It is important for the effective operation of the apparatus that the culture media powder remain relatively dry prior to use. Hygroscopic powders tend to clump under humid conditions and reconstitution becomes difficult. It is therefore contemplated that the commercial product comprising a mixing apparatus system with powder be packaged under vacuum and/or preferably be provided with a desiccant.

The manufacture of the mixing apparatus in accordance with the present invention can be accomplished using materials and techniques which will be well known to those of skill in the art. In a preferred embodiment, the mixing chamber base and cap are made of a nonreactive plastic polymer such as polycarbonate. Alternatively, the cap and base could be molded from other plastics including polysulphone. Other materials include metal alloys, plexiglass or glass.

Returning to FIG. 2, the base 46 may be conveniently integrally molded with chamber housing 48. Alternatively, base 46 is assembled together with the lower chamber housing 48 to form a liquid tight seal. The lower chamber housing is preferable molded from any of a variety of materials which will remain generally non-reactive in the intended use environment, such as polystyrene, polyethylene, polycarbonate, plexiglass, lucite, polypropylene or a metal alloy. Preferably, the chamber housing 48 will be transparent to enable visual observation of its contents or the progress of the mixing cycle.

The chamber housing and the mixing chamber base are conveniently provided with a liquid tight seal through the use of an elastomeric O-ring. The first chamber can either slip fit into an annular recess on the base or threadably engage the base. The housing can additionally be sealed to the base using adhesives, a heat seal or other means known in the art.

A protective cap is provided to cover the inlet port thus preventing powder from spilling out prior to use.

During assembly of a preferred embodiment, the lower chamber is supplied with powdered media and a Porex-type microporous circular filer disc (Porex Technologies, Fairburn, Ga.) or other filter, preferably having a 90–130 micron pore size, is placed on the filter support structure. Upper chamber housing 60 is sealed to lower chamber housing 48, preferably in association with O-ring 56 or any other method for creating water tight seals. Upper chamber housing 60 is preferably made from the same material as the lower housing, and the two chamber housings may be integrally formed as an elongate cylindrical body. However, it is additionally contemplated that the two chamber could be manufactured from different materials. Chemical B is added to the upper chamber and the upper chamber housing is similarly affixed to the mixing chamber cap having effluent port 32. The mixing chamber cap is affixed to upper chamber casing preferably in association with a rubber O-ring or other conventional sealing means.

There are a number of materials that could be used for the manufacture of the mixing chamber apparatus of FIG. 2. The choice of materials will be dictated by the choice of solvent and chemical destined for reconstitution. To avoid chamber and solvent reactivity, chamber materials and sealing devices should be relatively resistant to solvent degradation. The choice of chamber materials and sealing mechanisms could additionally be dictated by thermal considerations depending upon the reactivity of the solvent with chemical A or B. Thus, chemicals initiating intense exothermic reactions should typically not be placed in a mixing apparatus, for example, sealed with heat sensitive glue. The choice of materials, solvents, and chemicals for functional mixing chamber assembly will be apparent to those with skill in the art. The materials listed above are exemplary and should in no way be construed as limiting upon the invention disclosed herein.

If a sterile reconstituted product is required, then a sterilization exit filter apparatus 36 is preferably provided (see FIG. 1). Flexible tubing for providing communication between system components may be sterilized, such as by autoclave or gamma irradiation, and assembled together at the point of manufacture. It is additionally preferred that a sterile receiving receptacle be supplied with the apparatus. The sterile receiving receptacle could be glass, plastic, or metal and could be preformed or flexible. In a preferred embodiment, the receiving receptacle comprises a sterile flexible bag such as the Media Manager Produce (Irvine Scientific, Santa Ana, Calif.).

In a preferred application of the invention, the chemical A is powdered tissue culture media such as DME, available from Irvine Scientific, Santa Ana, Calif., nd chemical B is sodium bicarbonate ($NaHCO_3$) and/or other appropriate buffers or additives depending upon the media. Reconstituted, buffered tissue culture media enters receiving receptacle 40 as shown in FIG. 1.

Multiple inlet ports 42 may also be used to supply additional additives such as HCl or NaOH to adjust the pH of the reconstituted media. Glutamine and additional buffering agents may also be added through these ports. The final product is mixed by shaking the receptacle 40 and used directly out of receptacle 40 or aliquoted into additional sterile vessels.

The following are preferred embodiments of the disclosed apparatus illustrating the use of the mixing chamber device together with a sterilization filter and holding receptacle for the reconstitution of tissue culture media.

EXAMPLE 1

The mixing apparatus is designed for the reconstitution of 10 liters of Eagles Minimum Essential Medium (MEM). The overall configuration of the apparatus can be observed in FIG. 1. The apparatus is provided as a cylindrical dual chamber system having lower chamber dimensions of 4.5" diameter×4"0 height, and upper chamber dimensions of 4.5" diameter×1.5" height. The influent port has a cross-sectional diameter of 3/16". Upper and lower mixing chamber housings are molded from polystyrene. The mixing chamber base and mixing chamber cap are molded from polypropylene and for this particular embodiment, a 0.25-inch air space is provided between effluent filter 64 and the interior surface of the mixing chamber cap. Flexible silicone tubing connects a nylon sterilization filter obtained from Pall Corporation to effluent port 32. Sterile silicone tubing connects the sterilization filter with a 10-liter Media Manager receiving receptacle (Irvine Scientific, Santa Ana, Calif.).

During assembly of the mixing chamber, MEM powder having a granulation size of about 70–120 micron is added to the lower chamber and powdered sodium bicarbonate is added to the upper chamber. MEM powder can be purchased as a prepared powder from Irvine Scientific or the individual ingredients can be purchased from chemical suppliers known to those with skill in the art. The quantity of each component to prepare 10 liters of a typical MEM formulation at a 1X concentration are provided below.

| Component | Amount (g) | Component | Amount (g) |
|---|---|---|---|
| $CaCl_2$ | 2.0 | KCl | 4.0 |
| $MgSO_4$ | 2.0 | NaCl | 68.0 |
| $Na_2HPO_4$ | 1.4 | D-Glucose | 10.0 |
| Phenol Red | 0.1 | L-Arginine | 1.26 |
| L-Cystine | 0.24 | L-Glutamine | 2.92 |
| L-Histidine | 0.42 | L-Isoleucine | 0.52 |
| L-Leucine | 0.52 | L-Lysine HCl | 0.72 |
| L-Methionine | 0.15 | L-Phenylalanine | 0.32 |
| L-Threonine | 0.05 | L-Tryptophan | 0.10 |
| L-Tyrosine | 0.36 | L-Valine | 0.46 |

and 10.0 mg of each D-Ca pantothenate, Choline chloride, Folic Acid, Nicotinamide, Pyridoxal HCl, and Thiamine HCl. 20 mg I-inositol and 1.0 mg Riboflavin are additionally added.

Twenty-two grams of Sodium Bicarbonate are placed in the upper chamber.

The foregoing are all provided in a closed system comprising the mixing chamber, tubing, sterilization filter and Media Manager receiving receptacle to the user in packaged form under vacuum, with desiccant.

EXAMPLE 2

To use, the filled apparatus of Example 1 is removed from its packaging. Additional tubing is attached to a double deionized water source (preferably tap $ddH_2O$, or alternately a water source associated with a pumping apparatus). No special equipment or sterile technique is required. The cap is removed from the hose barb influent port and tubing is attached over the hose barb. The Media Manager receptacle may be placed on a scale and the mixing chamber device is placed upright on a solid surface.

Water is directed through the apparatus, through the chambers and sterilization filter, and reconstituted media flows into the Media Manager receiver. During operation, the water flow is turned off occasionally for about five seconds each time to relieve pressure in the system. When the receiver has been filled, an aliquot is tested for pH and HCl may be added through one of the multiple inlet ports to reach a desired endpoint pH of within the range of from about 6.8 to about 7.5. In addition, other amino acids, other buffers (i.e., HEPES $C_8H_{18}N_2O_4S$) or supplemental glucose can be added through multiple inlet ports 42.

The receptacle is disconnected from the sterilization filter and capped, and the receptacle is inverted briefly or agitated to mix the contents before use. The media can be used directly for large batch tissue culture or can be aliquoted into smaller volumes if desired.

The above examples describe the use of the disclosed invention for the reconstitution of Minimum Essential Media for tissue culture. There are numerous other tissue culture medias that could be prepared using the disclosed apparatus. These include but are not limited to F-10 Nutrient Mixture (Ham), Dulbecco's Modified Eagle Media (DME), and RPMI Media 1640. It is contemplated that a custom media could additionally be supplied in the above mixing chamber or that a variety of other laboratory chemicals and buffers could be provided for commercial use. Bacterial growth media could also be provided in the disclosed apparatus.

Certain laboratory reagents are used in large scale. Tris-acetate buffers, Tris-borate buffers, or glycine based electrophoresis buffers could be provided in the contemplated mixing chamber apparatus together with a filtration device.

It is additionally contemplated that the apparatus disclosed herein has a number of other commercial or industrial applications. For example, many liquid pharmaceuticals are prepared in the hospital pharmacy with some frequency and quantity. Saline solutions, alimentary preparations, imaging reagents, dyes, sterilization solutions and anesthetics are reconstituted as liquids. Premeasured aliquots provided ready for reconstitution such as contemplated by the disclosed invention would provide an advantage over the current art.

Alternative applications include, but are not limited to, preparation of pesticides, fertilizers, any of a variety of beverages commonly prepared from powder such as milk, iced tea, etc. which could all be reconstituted using the disclosed invention. It is further contemplated that the liquid solvents employed by this invention could be water, alcohols or other organics. The solubility characteristics, the solvent to be used, the amount required and the chemical interactions between the solvent and the reconstituted chemicals will serve to provide guidelines for the size of the mixing chamber and the choice of materials for the components as described in association with FIG. 2.

A variety of modified forms of the invention can be constructed for different end uses. For example, the diagrams depict a preferred embodiment wherein the first mixing chamber is coaxially aligned beneath the second chamber and separated by a microporous circular filter disc. In this embodiment the upper and lower chambers both have a cylindrical shape and the circular filter disc follows the shape of the chamber casing. As noted, the lower chamber preferably has a generally cylindrical shape in order to facilitate rotational fluid velocity of sufficient turbulence.

However, it is not necessary for the upper chamber to have a cylindrical shape. Other shapes for the second chamber as well as for the microporous filter disc are contemplated. The second chamber could be rectangular, ovoid or essentially spherical. Further, the first and second chambers do not necessarily have to be positioned on top of one another. It is contemplated that the two chambers could be disposed side by side or remote from one another and in fluid communication by way of silicone, glass or other conventional tubing.

Depending upon the chemistry of a given system, a single mixing chamber may be all that is required. Alternatively, more than two chambers could additionally be linked in succession within the same tubular housing for the sequential dissolution or reconstitution of more than two chemicals. Each chamber is typically defined by a chamber divider, preferably a filter, such as the microporous filtration disc located between the first and second mixing chambers of the preferred embodiment shown in FIG. 2. This would prevent undissolved solids from passing between chambers. The chambers may be all contained within a single housing or provided as individual remote units. These are linked in succession with tubing or other connection devices known to those in the art.

It is also contemplated that other applications for the disclosed invention may require the apparatus to have more than one influent port. There are chemical mixtures that require the simultaneous addition of two or more solvents for reconstitution of a given powder or concentrate. For example, the preparation of chemicals containing EDTA (ethylenediamine tetraacetic acid)

using the disclosed apparatus could require two influent ports. The disodium salt of EDTA will not go into solution until the pH of the solution is approximately 8.0. Therefore, the preparation of a buffer containing EDTA could require an influent port for water and an additional port for a NaOH solution to fully dissolve the powder contained in the provided chamber.

Figure 6:
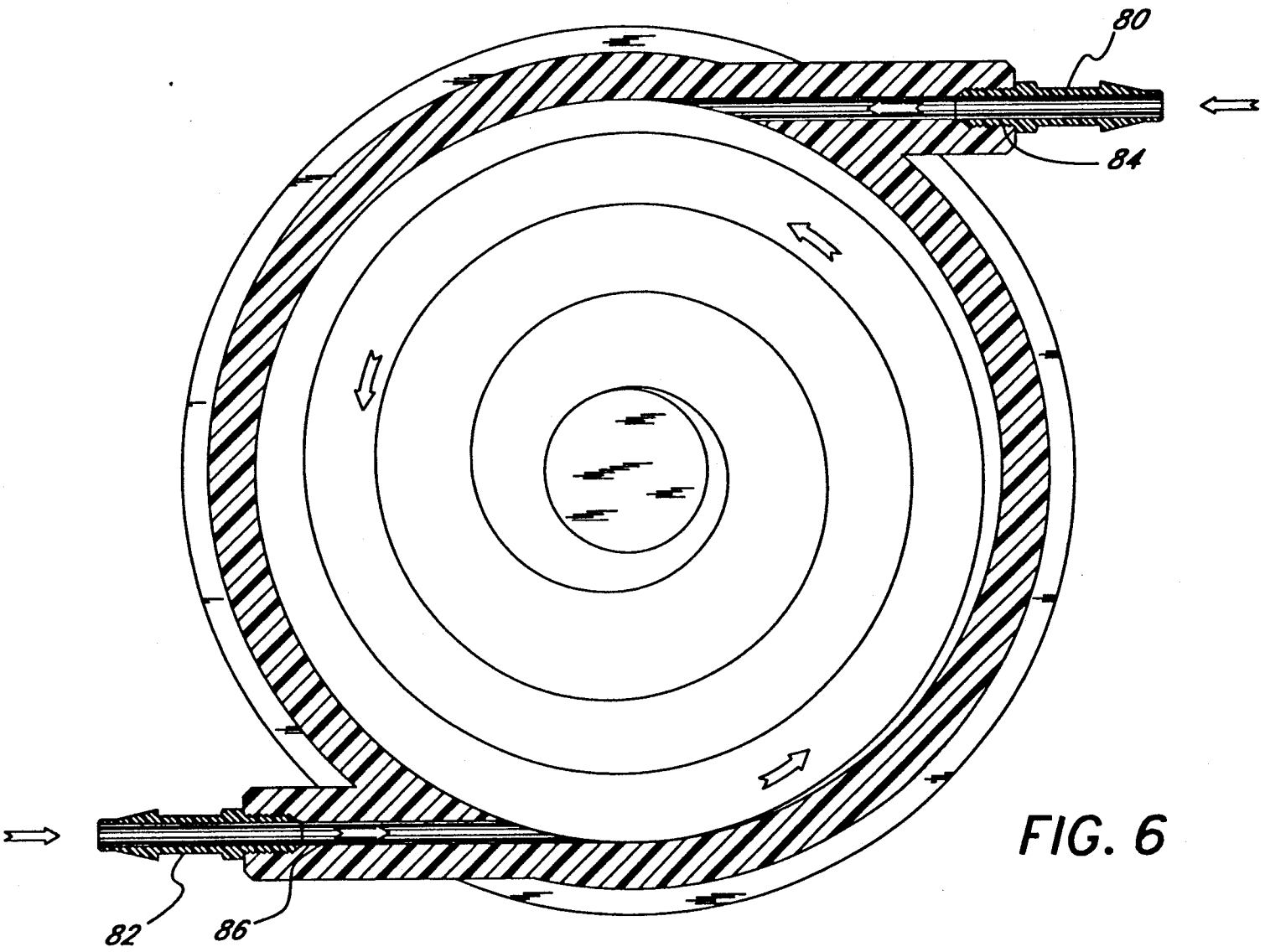
FIG. 6 is a cross-sectional view of an additional embodiment having two influent ports on the same horizontal plane with complementary influent flow paths.

The influent ports can be positioned on the same horizontal plane, along the same vertical plane, or elsewhere, depending upon particular requirements of a given application. FIG. 6 provides a cross-sectional view of a mixing chamber embodiment having two influent ports 80 and 82 positioned along the same horizontal plane. If mixing relies solely on influent flow pressure to create fluid turbulence then the influent ports 80 and 82 are preferably both aligned tangentially to the interior surface of the first chamber.

In the illustrated two-part embodiment, influent ports 80 and 82 have equal port diameters 84 and 86. The diameters may be individually modified for varied influent flow velocities. Further, the inflow ports should be positioned so that the inflow from port 80 does not interfere with the inflow from port 82. The arrows illustrated in FIG. 6 indicate that fluid tangentially entering the mixing chamber from both ports flows in tandem to maintain vortex activity.

The second influent port could alternatively be situated in the same vertical plane as the first influent port. Fluid entering the second port at a sufficient velocity assists the vortex created by fluid entering from the first port. For the reconstitution of large amounts of dry powder or viscous solutions, two influent ports might better facilitate complete mixing. Thus, water or other solvent could be added from more than one influent port solely to support vortex generation. Alternatively, the liquids entering the apparatus through multiple influent ports could be of different chemical composition.

Where multiple ports are used, the interior diameters of each of the ports and influent pressures can be varied to promote mixing of the desired reagents. A smaller diameter port situated above a larger diameter port would provide additional inflow velocity over the larger diameter port. In this way an efficient vortex could be maintained to maximize reconstitution of a given powder mixture. These design features will be added or included depending on the solubility of the powder in a particular application, the volume of powder relative to the chamber size and by the chemistry required to reconstitute a given liquid preparation.

Figure 7:
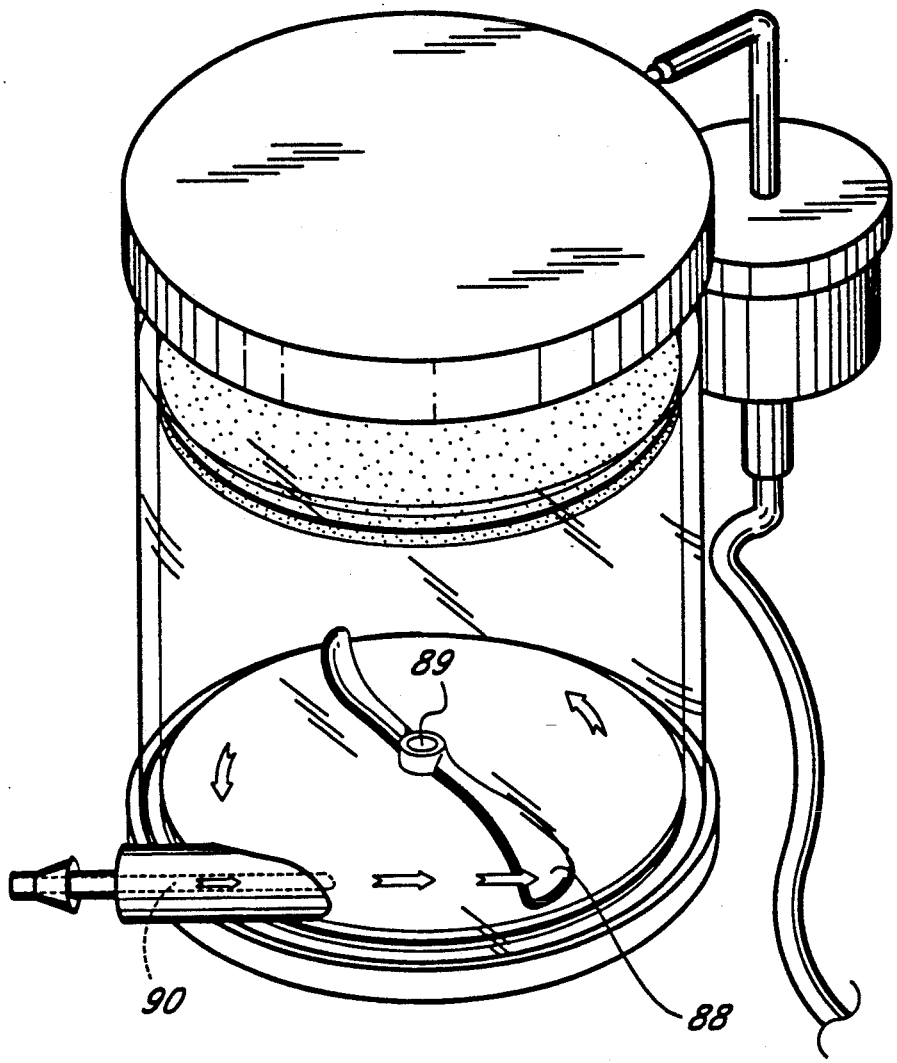
FIG. 7 is an elevational perspective view of an additional embodiment of the invention having rotatable stirring blades.

If additional turbulence is required to reconstitute one or more of the chemicals, additional water-driven stirring means may be added to facilitate mixing either instead of or along with the tangential inflow vortex mixing discussed above. For example, turbine-like stirring blades added to the lower chamber could add additional turbulence. Referring to FIG. 7, stirring blades 88 are freely rotatable around a central axis 89. Fluid entering influent port 26 initiates rotational movement of blades 88 and blade rotation supports increased turbulence within the chamber and provides a fluid rotation guide for additional incoming fluid. In the illustrated embodiment, the axis of influent port 90 is aligned to direct an incoming stream directly against the blades 88. Alternatively, blades 88 can be provided in the embodiment illustrated in FIG. 2 or 6 having a tangential flow alignment.

In an alternative water-driven mixing embodiment, the influent fluid stream is first directed through an external turbine located outside of the mixing chamber, preferably within a separate turbine chamber. The force of the liquid under pressure initiates the rotation of the external turbine blades and rotation is maintained by the velocity of additional liquid entering the apparatus. The liquid effluent leaving the activated turbine blades is thereafter directed through a tangential influent port or other influent port leading to the mixing chamber.

Liquid entering the mixing chamber from the turbine chamber contacts a set of mixing blades which may be similar to the blade system illustrated in FIG. 7. These blades are driven by the rotational energy form the turbine chamber blades and preferably also by the tangential inflow of the influent liquid under pressure.

This invention discloses a number of embodiments that provide a closed, self-contained mixing system to reconstitute a unit dose of chemical into a known final liquid volume. The discussion provided above serves to point out those design features that can be modified to adapt the disclosed apparatus for a wide range of applications. The desirability of specific influent port angles, position, number and diameter along with chamber dimensions, fluid pressure and a need for external turbulence generators are design features which will be able to be readily optimized by one of skill in the art for the reconstitution of a given formulation.

In accordance with a further embodiment of the present invention, a second water-driven mixing chamber is provided by directing the effluent from the first chamber through an orifice aligned along a tangent to the interior wall of a second generally cylindrical chamber. In this embodiment, the same influent stream is used to sequentially drive two successive vortex mixing chambers in series relationship where chemical B requires some agitation to dissolve.

In accordance with another embodiment of this invention there is provided a mixing apparatus wherein the influent stream is divided into two or more parallel flow paths before entering the first mixing chamber and each flow path is directed to a separate mixing chamber. In this embodiment, two or more mixing chambers are provided in parallel fluid flow relationship, each with separate chemical contents such that two or more chemicals can be individually and simultaneously reconstituted. It is further contemplated that the plurality of multiple mixing chambers could be maintained as separately reconstituted units, or the effluent streams can be recombined to produce a single volume of reconstituted product. Physically, the plurality of mixing chambers can either exist as separate structures, or combined together such that each mixing chamber comprises a separate chamber within a common housing.

For example, in a modification of the embodiment depicted in FIG. 5, the influent stream is divided to provide an influent stream through influent port 26 and also through a second influent port (not illustrated) tangentially aligned to the interior wall of chamber 24.

In this embodiment, mixing of chemical A with chemical B can occur after both chemicals are reconstituted by elimination of fluid communication directly between the two chambers. It is further contemplated that the influent stream can be divided unequally between the multiple chambers. In this example, the fluid dividing fork or influent ports may have flow paths of varied diameter to direct the majority of fluid into the first chamber and less fluid into the second. This promotes vortex formation in the first chamber during the simultaneous reconstitution of both chemicals.

While the preferred embodiments described herein employ powdered chemicals, it is contemplated that the mixing apparatus of the present invention will work equally well for the reconstitution of a concentrated liquid or a sequential combination of liquid and powder.

More viscous solutions or chemicals with reduced solubility may require some externally powered mechanized mixing. Magnetic stir bars can be provided in either the lower or upper chambers to facilitate mixing when the apparatus is placed on a magnetic stir plate. Further, a motor driven impeller can be provided for connection to a motor to create a vortex of sufficient strength to reconstitute the dry powder.

Thus, in an additional embodiment a mechanized impeller or other internal rotation device is used to provide a rotational force to generate sufficient liquid turbulence to reconstitute the chemical contained in the self-contained unit dose reconstitution system disclosed herein. If sufficient mixing force can be generated by the motor driven impeller or other rotational device then the fluid need not enter the chamber at a tangential angle and, where more than one influent port is required, these ports need not be aligned in the same vertical or horizontal plane.

Thus, the invention disclosed provides a method and apparatus for the single step preparation and, if required, sterilization of a given chemical. The system is closed, therefore handling is minimized. All chemicals are premeasured so employee efficiency is maximized. The closed system additionally permits a complex sequential or multicomponent reconstitution and sterilization process to be performed in a convenient location without the risk of contamination and with minimal variation in end product due to technician error or batch variation. In addition, the combination of a closed system with desiccant under vacuum yields prepackaged units having a relatively long shelf life and improved tolerance to temperature change over the corresponding liquid product.

The invention disclosed herein has numerous applications and while particular embodiments of the invention have been described in detail, it will be apparent to those skilled in the art that the disclosed embodiments may be modified given the design considerations discussed herein. Therefore, the foregoing description is to be considered exemplary rather than limiting, and the true scope of the invention is that defined in the following claims.

We claim:

1. A method of reconstituting a powdered media in a buffer solution, comprising the steps of:

providing a vortex mixing apparatus having powdered culture media in a first mixing chamber therein and a buffer material in a second mixing chamber therein;

introducing an influent fluid stream under pressure into the first mixing chamber for mixing with the powdered culture media and creating a mixture therein; and thereafter directing the mixture into the second mixing chamber for contacting the buffer material to produce a reconstituted media.

2. A method of reconstituting a powdered media as in claim 1, further comprising the step of filtering the mixture so that the mixture which is directed into the second mixing chamber is substantially free of unmixed powdered culture media.

3. A method of reconstituting a powdered media as in claim 1, further comprising the step of directing said reconstituted media through a sterilization filter.

4. A method of reconstituting a powdered media as in claim 3, further comprising the step of directing the sterilized reconstituted media into a sterile receptacle.

5. A method of reconstituting a powdered media as in claim 1, further comprising the step of directing said reconstituted media into a receptacle having a predetermined volume.

6. A method of reconstituting a powdered media as in claim 5, wherein the volume of said influent stream is sufficient when mixed with said powdered culture media and said buffer material to produce a reconstituted media having said predetermined volume.

7. A method as in claim 5, wherein said introducing step comprising introducing said influent fluid stream until said receptacle is substantially full, and then discontinuing said influent fluid stream.

* * * * *